US005365704A

United States Patent [19]

Ray

[11] Patent Number: 5,365,704

[45] Date of Patent: Nov. 22, 1994

[54] ACTIVITY FLOOR CHANGING SYSTEM FOR MULTI-ACTIVITY COMPLEX

[76] Inventor: William W. Ray, 42 High St., Peterborough, N.H. 03458

[21] Appl. No.: 228,299

[22] Filed: Apr. 15, 1994

Related U.S. Application Data

[62] Division of Ser. No. 27,201, Mar. 5, 1993, Pat. No. 5,319,895.

[51] Int. Cl.[5] ..... E04B 1/343

[52] U.S. Cl. ..... 52/64; 52/6; 52/7; 52/125.1; 52/126.5; 52/741.1; 472/92

[58] Field of Search ..... 52/6, 7, 64, 125.1, 52/126.5, 741.1; 472/92

[56] References Cited

U.S. PATENT DOCUMENTS

| | | | |
|---|---|---|---|
| 3,399,887 | 9/1968 | Altier | 52/7 |
| 3,975,869 | 8/1976 | Bouton | 52/64 |
| 4,735,024 | 4/1988 | Rosato et al. | 52/7 |

FOREIGN PATENT DOCUMENTS

| | | | |
|---|---|---|---|
| 0374104 | 6/1990 | European Pat. Off. | 52/126.5 |

*Primary Examiner*—Carl D. Friedman
*Assistant Examiner*—Christopher Todd Kent
*Attorney, Agent, or Firm*—George W. Dishong

[57] ABSTRACT

A multi-activity complex incorporates a plurality of activity floors, each of which has an associated playing surface and is selectively movable between a storage position, located below an event staging or activity area, and an in-use position located in the activity area. A system is provided for alternatively shifting the activity floors between the respective storage and in-use positions. The shifting system includes a lift assembly for vertically moving the activity floors into and out of the activity area and a second mechanism for laterally shifting the activity floors to and from a respective storage area disposed below and laterally outwardly of the activity area.

3 Claims, 4 Drawing Sheets

ACTIVITY FLOOR CHANGING SYSTEM FOR MULTI-ACTIVITY COMPLEX

This application is a division of application Ser. No. 08/027,201, filed Mar. 5, 1993, now U.S. Pat. No. 5,319,895.

BACKGROUND OF THE INVENTION

1. Field Of the Invention

The present invention pertains to a multi-activity complex and, more particularly, to an activity floor changing system for use in a multi-activity complex.

2. Description of the Prior Art

In recent years, arenas, stadium, and sports facilities have been designed to host multiple activities including various athletic events, musical concerts, circuses, expositions and the like. In order to stage such varying events, it is often necessary to alter the characteristics of at least one activity area of the complex. For example, many sport complexes are utilized for both ice hockey and basketball. When such a sports complex is used for hockey, an activity area is provided with a layer of ice. When it is desired to utilize the same activity area for a basketball event, a removable basketball playing surface is laid upon the layer of ice. This arrangement not only limits the type of flooring that can be used for the basketball surface, but it can be cumbersome and time consuming to alter the surface of the activity area.

There have been additional attempts in the prior art to provide a multi-activity complex wherein the surface characteristics of an activity floor can be altered. For instance, U.S. Pat. No. 2,766,046 discloses a multi-activity complex that includes an activity area which can be used alternately as a swimming pool, a skating rink or an exhibition floor. In general, the multi-activity complex disclosed in the '046 Patent provides a swimming pool having a substantially level central section and a pair of end sections. When all three sections are filled with water, the complex constitutes a swimming pool. If the water is drained, the substantially level central section can be boxed off and used as an exhibition floor for other activities such as tennis matches. Refrigeration pipes can also be laid on the central section such that a thin layer of water may be pumped thereupon and later frozen in order to utilize the central section as a skating rink. Although this arrangement enables a single complex to be used for multiple activities, it is very time consuming to alter the characteristics of the activity floor and the number of activities that can be readily conducted at the complex is limited.

It is also been heretobefore proposed to provide a multi-purpose stadium including a first activity area having a natural turf playing field and a second activity area, positioned below the first activity area, having a second playing field surface. This multi-purpose stadium arrangement is disclosed in U.S. Pat. No. 5,103,600 wherein multiple activity surfaces are vertically spaced from one another such that multiple activities can be conducted at the stadium simultaneously. In addition, the activity surfaces can be moved vertically to position a desired playing surface at an optimum viewing level. When one of the lower activity surfaces is raised to a predetermined height, the upper activity surface constitutes a roof portion so as to enclose the stadium. This arrangement is particularly adapted for use with baseball stadiums and requires a complex and intricate support system since the various playing surfaces extend over a large area. In addition, the number of activities that can be performed in the manner set forth in the '600 Patent is confined by the space parameters necessary in the design of the system wherein the various playing surfaces must be spaced vertically by a substantial distance such that, for example, a lower surface can be used while the upper surface forms a roof portion as discussed above.

Therefore, there exists a need in the art for a complex that can be used for multiple activities wherein the various activity or playing surfaces can be selectively shifted between storage and in-use positions in a relatively simple manner while requiring a minimal amount of space for storage.

SUMMARY OF THE INVENTION

It is an object of the present invention to provide a multi-activity complex having at least one activity area, the characteristic of which can be readily changed so as to enable the complex to be used for various events.

It is another object of the present invention to provide a multi-activity complex which includes a plurality of activity floors each of which are selectively movable between a storage position located below and laterally outward of the activity area and an in-use position wherein the selected activity floor is supported in the activity area.

These and other objects of the present invention are accomplished by providing a multi-activity complex having a base, defining at least one activity area, below which is provided a plurality of vertically spaced storage areas. Each of the storage areas are adapted to house different activity floors that can be selectively moved into the activity area of the complex such that the complex can be used for various events. This arrangement includes a mechanical system for alternatively moving the various floors between their respective storage and in-use positions. This mechanical moving system includes a first mechanism for shifting each of the activity floors in a generally horizontal plane onto a support structure and a separate system for vertically shifting the support structure, with the selected activity floor thereon into the activity area.

Other objects, features and advantages of the invention shall become apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figure 1:
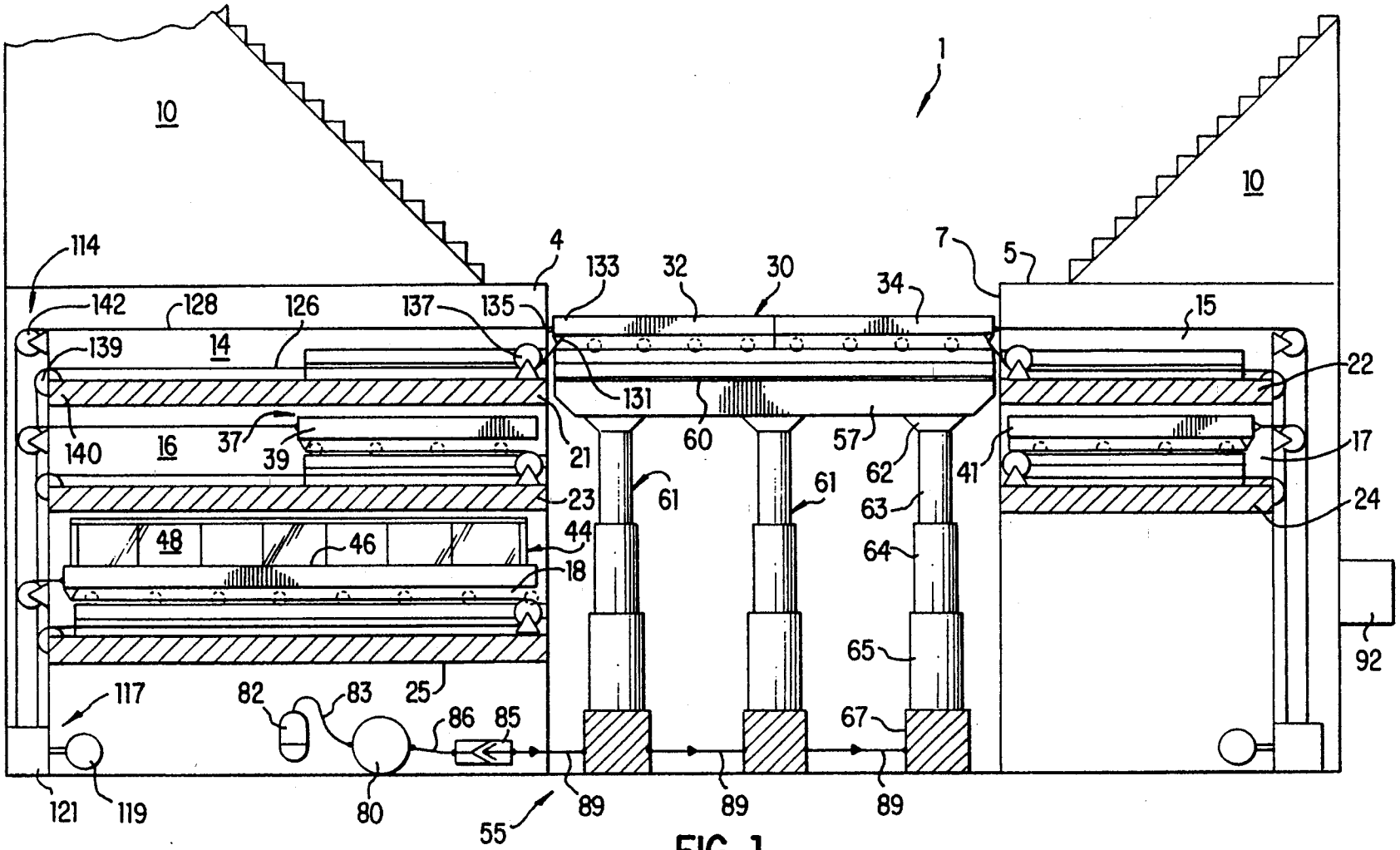
FIG. 1 is schematic, elevational side view of the multi-activity complex of the present invention.

With initial reference to FIG. 1, the multi-activity complex of the present invention is generally indicated at 1 and includes a base 4 having a surface 5 that is located in a generally horizontal plane. Base 4 defines an activity area 7 into which a selective one of a plurality of activity floors is adapted to be placed as will be more fully discussed below. Complex 1 further includes a plurality of bleachers 10 for use in view an event taking place in activity area 7.

Below base 4, at predetermined vertically spaced intervals, are a plurality of storage areas 14-18. Storage areas 14-18 are provided with respective storage platforms 21-25 such that storage areas 14 and 15 are located in the same horizontal plane between base 4 and storage platforms 21 and 22 respectively; storage areas 16 and 17 are located in another horizontal plane and are defined between storage platforms 21 and 22 and 22 and 24 respectively; and storage area 18 is located below storage area 16, between storage platforms 23 and 25. At this point, it should be noted that the entire structural supports for, storage platforms 21–25, base 4 and bleachers 10 have not been shown in the drawings for clarity. In the preferred embodiment, storage areas 14–18 are located below ground level with base 4 and storage platforms 21–25 being cantilevered. In addition, supplemental vertical supports may interconnect the cantilevered ends at the four corners of activity area 7. Of course, various additional truss or aerial cable suspension arrangements could also be utilized as would be apparent to one of ordinary skill in the art.

As previously stated, activity area 7 is adapted to alternatively have one of a plurality of activity floors positioned therein. The particular surface characteristics of the selected activity floor would depend upon the activity which complex 1 is being use for at any given time. In the embodiment shown, three different, exemplary activity floor arrangements have been depicted. As shown in FIG. 1, a first activity floor 30 includes a first section 32 and a second section 34. First section 32 is adapted to be stored upon storage platform 21 in storage area 14 while second section 34 of first activity floor 30 is adapted to be stored upon storage platform 22 within storage area 15. When first activity floor 30 is selected for use, it is shifted to an in-use position wherein it is located in activity area 7 in a manner which will be fully discussed below. In a manner similar to first activity floor 30, multi-activity complex 1 is provided with a second activity floor 37 having a first section 39 adapted to be stored upon storage platform 23 within storage area 16 and a second section 41 adapted to be stored upon storage platform 24 within storage area 17. Finally, a third activity floor 44 is provided which is stored upon storage platform 25 within storage area 18. In the embodiment shown, third activity floor 44 is adapted to be used for ice skating events, such as figure skating and hockey, and includes a skating surface 46 surrounded by plexi-glass walls 48. Below skating surface 46, third activity floor 44 is provided with a self-contained refrigeration system (not shown) for use in maintaining ice upon skating surface 46.

Figure 2:
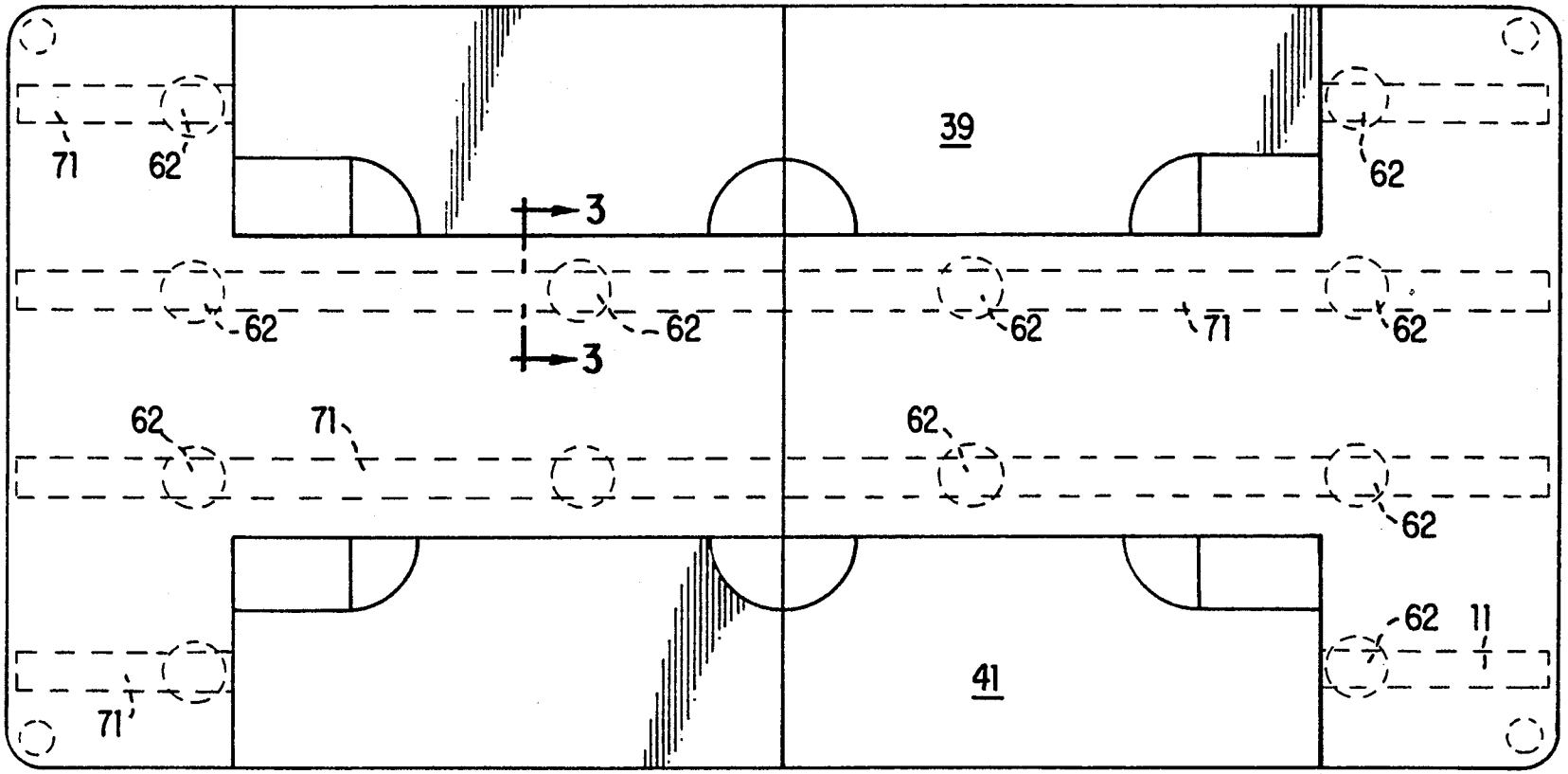
FIG. 2 is a top view of one activity floor incorporated in the multi-activity complex of FIG. 1.

In FIG. 1, third activity floor 44 is depicted as a unitary structure while first and second activity floors 30 and 37 are depicted as sectional. Obviously, the use of sectional floors enables storage platforms 21–24 to be made shorter in length than storage platform 25. Of course, shorter platform lengths require less structural support and therefore may be structurally advantageous in some environments. It is possible to divide activity floors 30 and 37, along with activity floor 44, into any number of sections. If third activity floor 44 is sectioned, once activity floor 44 is positioned within activity area 7, any distance between the sections would be filled with water such that they could freeze. When it is again necessary to move third activity floor 44 into storage, the spaces between the sections would be reestablished by any means known in the art. It should also be recognized at this point that although only three activity floors have been discussed, the actual number of activity floors can vary greatly. In the embodiment shown, first activity floor 30 constitutes a general use floor, second activity floor 37 comprises a specific sport activity floor such as a basketball court as shown in FIG. 2 and third activity floor 44 comprises an ice rink as discussed above.

As also shown in FIG. 1, multi-activity complex 1 includes a lift assembly generally indicated at 55. Lift assembly 55 includes a support base 57 having a base surface 60. Support base 57 is positioned by means of various columns 61, each of which carries a top support member 62 in engagement with support base 57. Each column 61 comprises a plurality of telescoping sections 63, 64 and 65 which are attached to an anchor chamber 67. Specific details of lift assembly 55 will be further described below, however, it should be understood that the structure and function of lift assembly 55 is generally known-in the art of jacks and is of the type commonly used as automotive vehicle lift assemblies. In addition, base surface 60 itself could define another activity floor. For instance, the ice rink surface discussed above with respect to third activity floor 44 could be located upon support base 57. In this case, flexible refrigeration hoses would extend to the refrigeration system and the other activity floors could be alternately supported thereon. This arrangement would be advantageous in that the ice would provide a firm and strong support for the other activity floors and a unitary ice surface could be provided without the need for an enlarged storage area.

Figure 3:
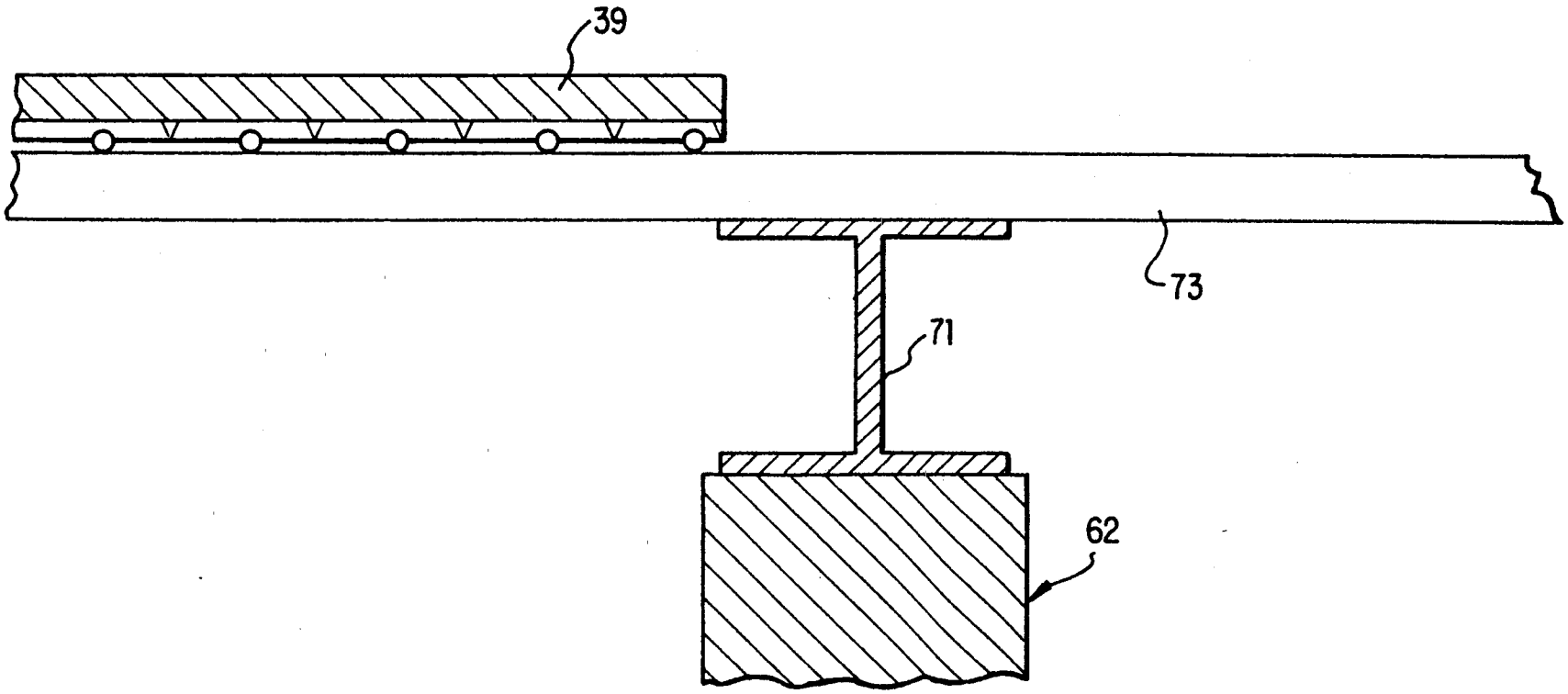
FIG. 3 is a partial, cross-sectional view taken along line 3—3 in FIG. 2.

Further details of the invention and particularly lift assembly 55 will now be further described with reference to FIGS. 1–3. Support base 57 of lift assembly 55 comprises a plurality of I-beams 71 which extend across and rest upon numerous support members 62. In the preferred embodiment, I-beams 71 are slightly less in length than activity area 7 so as to extend substantially the entire length of the selected activity floor, which in FIGS. 2 and 3 is depicted as second activity floor 37. Although only three laterally spaced columns are depicted in FIG. 1, four such laterally spaced columns are utilized in the preferred embodiment to support the selected activity floor 30, 37 or 44 as best shown in FIG. 2. In addition, a plurality of longitudinally spaced columns 61 are provided upon which each I-beam 71 rests. Of course, the number of columns 61 which are utilized can be altered depending upon the structure of the playing surfaces and the construction of the various floors, as well as the size of each column 61 and I-beam 71. Again, it should be realized that although columns 61 and each I-beam 71 have been disclosed as the preferred manner in which the selected activity floor is vertically supported in its in-use position, various other support arrangements, such as telescoping truss structures or other known jack systems, could also be used.

In the embodiment shown, lift assembly 55 comprises a hydraulic system and includes at least one pump 80 which is adapted to draw hydraulic fluid from a sump tank or accumulator 82 through a first fluid conduit 83. The output from pump 80 is controlled by means of a control valve unit 85 which is in fluid communication with pump 80 through a second fluid conduit 86. Various output conduits 89 extend from control valve unit 85 and are adapted to raise or lower telescoping sections 63–65 each column 61 simultaneously. As will be more fully discussed below, control for the raising and lowering columns 61, as well as the movement of activity floors 30, 37 and 44 to and from their storage and in-use positions, is controlled by a closed loop control circuit 92.

Figure 5:
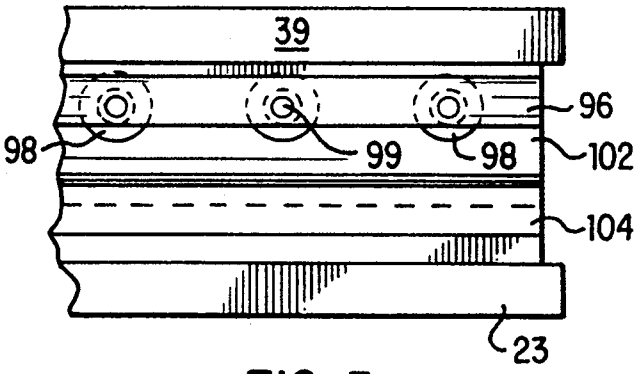
FIG. 5 is a side view of the support arrangement shown in FIG. 4.
Figure 4:
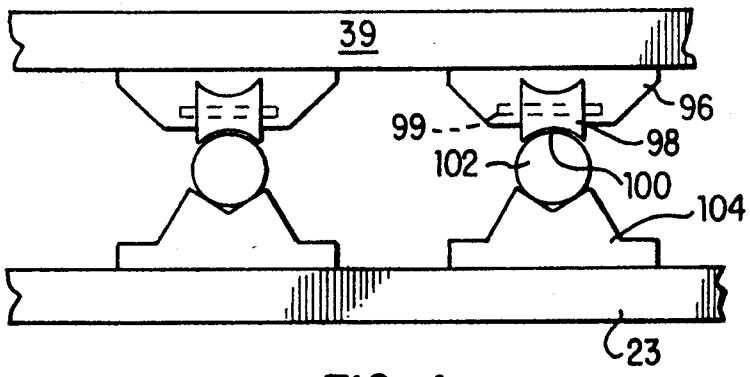
FIG. 4 is a front view depicting a portion of a support arrangement for use with the activity floors according to the invention.

Reference will now be made to FIGS. 4 and 5 in describing the manner in which activity floors 30, 37 and 44 are shifted between their respective storage and in-use positions. FIG. 4 depicts a front view of a portion of first section 39 of second activity floor 37 and FIG. 5 depicts a detailed side view of a portion of first section 39 of second activity floor 37 in a manner similar to that shown in FIG. 1. Secured to a lower surface (not labeled) of first section 39 are a plurality of longitudinally spaced elongated roller bearing attachment plates 96. Each attachment plate 96 has rotatably mounted thereon a plurality of laterally spaced rollers 98 by means of pins 99. As best shown in FIG. 4 and provided for in the preferred embodiment of the invention, rollers 98 have an annular concave rolling surface 100. Each roller 98 is secured to a given roller bearing attachment plate 96 and is adapted to roll upon a laterally extending guide rod 102. Laterally extending guide rod 102 is secured atop an elongated guide rod attachment plate 104 fixedly secured to storage platform 23. Although only a detailed explanation has been given of the rolling connection between first section 39 of second activity floor 37 and storage platform 23, it should be readily understood That a similar rolling connection exists between each activity floor 30, 37 and 44 and its associated storage platform 21–25. In addition, support base 57 of lift assembly 55 has also fixedly attached thereto a corresponding set of guide rods 102 and elongated guide rod attachment plates 104. Therefore, when support base 57 of lift assembly 55 is vertically positioned such that base surface 60 is at a height corresponding to a predetermined storage platform, the longitudinally spaced guide rods 102 provided on the support platform will be aligned with the guide rods 102 on support base 57 of lift assembly 55 such that the activity floor rolled out of its respective storage area and onto support base 57. Again, it should be recognized by one of ordinary skill in the art that various other guiding and shifting arrangements for moving the activity floors into and out of their respective storage areas may be utilized without departing from the spirit of the present invention.

Reference will now be made back to FIG. 1 in describing the system utilized to automatically shift a predetermined activity floor from its respective storage area to upon support base 57 of lift assembly 55 and vice-versa. In the preferred embodiment, this shifting arrangement comprises a motor driven cable assembly generally indicated at 114. Although numerous assemblies can be utilized depending upon the number of activity floors incorporated and the weight thereof, each motor driven cable assembly 114 includes winch unit 117 comprised of a motor 119 and a gear box 121. As each of the activity floors incorporated in the multi-activity complex 1 of the present invention is preferably shifted in the same manner, a detailed description will now be given to the manner in which the first activity floor 30 is shifted from its respective storage areas 14 and 15 onto support base 57 of lift assembly 55 and it is to be understood that the other activity floors can be shifted in a similar manner. Also, although activity floors 30, 37 and 44 are shown to be stored to the left and right of support base 57 in FIG. 1, these floors or additional floors could be stored in areas of the complex which are located into and out of the page depicting FIG. 1 as well.

Extending from gear box 121 is an extension cable 126 and a retraction cable 128. An end 131 of extension cable 126 is secured to an outer end portion 133 of first section 32. In a similar manner, end 135 of retraction cable 128 is likewise connected to outer end portion 133 of first section 32. Between its connection to first section 32 and its connection within gear box 121, remote cable 126 extends around a first guide pulley 137 and a second guide pulley 139. As shown in FIG. 1, first guide pulley 137 is fixedly secured to support platform 21 adjacent support structure 57 and second guide pulley 139 is attached to an end 140 of platform 21, removed from activity area 7. In a similar manner, retraction cable 128 extends from its attachment to first section 32 of activity floor 30 about a third guide pulley 142 and then is connected within gear box 121. Although the internal structure of gear box 121 is not particularly shown, it is to be understood that gear box 121 generally comprises a winch arrangement as is known in the art and is driven by motor 119. However, gear box 121 includes a reverse drive gear arrangement such that as extension cable 126 is wound up within gear box 121, slack is simultaneously provided on retraction cable 128. Likewise, when retraction cable 128 is wound up within gear box 121, slack is provided on extension cable 126.

As shown in FIG. 1, motor 119 has been operated such that extension cable 126 has been wound up within gear box 121 as far as possible while an equal amount of retraction cable 128 has been permitted to unwind out of gear box 121. Therefore, first section 32 of first activity floor 30 has been shifted from storage area 14 onto support base 57. As previously stated, the number of motors 119 and gear boxes 121 can vary in accordance with the present invention depending the weight of the activity floors 30, 37 and 44 and also the friction coefficient between rollers 98 and guide rods 102. Although it is possible to utilize separate motors 119 and gear boxes 121 to shift each of the activity floors 30, 37 and 44, in the preferred embodiment, a single motor 119 is used to alternatively drive various shafts within a single gear box 121, through the use of clutches or the like, such that a single gear box 121 can be utilized to wind and unwind extension and retraction cables for multiple activity floors. In addition, if multiple motors 119 are utilized, they will each be electrically connected to closed loop control circuit 92 such that the operation of the various motors 119 will be synchronized in order to assure that, for example, first section 32 and second section 34 of first activity floor 30 are simultaneously shifted between their respective storage and in-use positions.

Although various motor driven cable assemblies 114 have been depicted in the preferred embodiment of the invention for shifting the various activity floors, it should be readily understood that various other types of drive assemblies could also be incorporated including rack, and pinion systems as well as pneumatic floor lifting and shifting units. In addition, these drive units may be used in combination with one another such that, for example, a pneumatic lift system could be used to minimize the rolling friction between rollers 98 and guide rods 102 such that smaller motors 119 can be utilized. It should also be recognized that motors 119, which in the preferred embodiment are hydraulic motors, could also be electrically powered.

Figure 6:
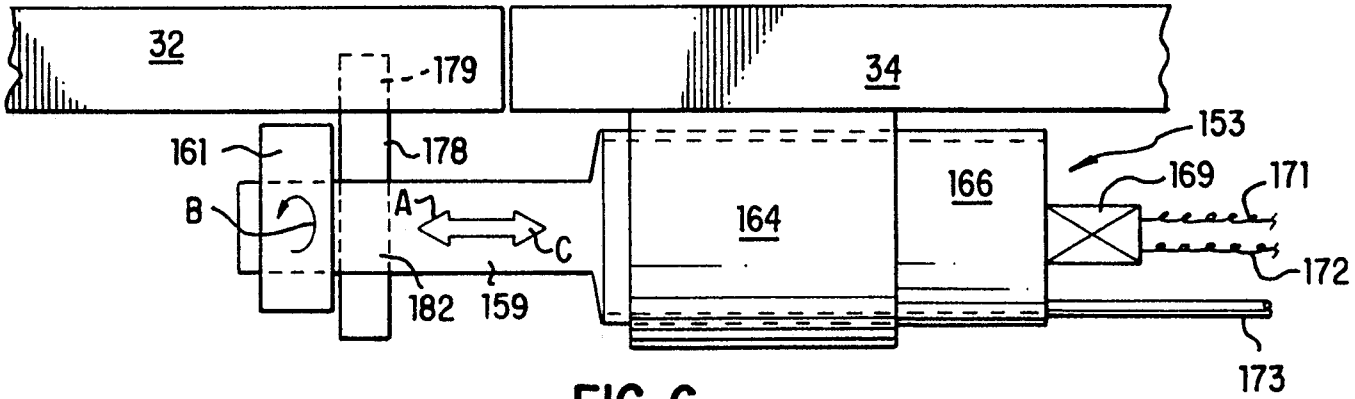
FIG. 6 depicts a latching arrangement for use with the activity floors according to the present invention.

Reference will now be made to FIG. 6 in describing a preferred embodiment of a locking arrangement for use in interconnecting two sections of an activity floor that is shifted onto support base 57. In FIG. 6, the locking arrangement comprises a rotary fluid latching mechanism 153 which is used to interconnect first and second sections 32 and 34 of first activity floor 30. Rotary fluid latching mechanism 153 includes a rotary/linear actuator unit 157. Rotary/linear actuator unit 157 includes a piston 159 having a locking plate 161 fixedly secured Thereto, a cylinder body 164, a motor 166 and a solenoid control valve assembly 169. Solenoid control valve assembly 169 includes leads 171 and 172 which are adapted to be connected to closed looped control circuit 92. In addition, rotary fluid latching mechanism 153 is interconnected to a source of hydraulic fluid pressure through an supply line 173.

As depicted in FIG. 6, cylinder body 164 is fixedly secured to second section 34 of first activity floor 30. Rotary fluid latching mechanism 153 further includes a connector plate 178 which has a first end 179 thereof fixedly secured to first section 32 of first activity floor 30. Connector plate 178 is also provided with a longitudinally extending slot 182, i.e. a slot that extends into the page as shown in FIG. 6, which as in length slightly longer than the length of the locking plate 161. By this arrangement, when first and second floor sections 32, 34 are fully shifted onto support base 57 of lift assembly 55, rotary fluid latching mechanism 153 can be activated by closed loop control circuit 92 such that piston 159 is extended in the direction of arrow A until locking plate 161 freely extends through slot 182 provided in connector plate 178. Once locking plate 161 has fully passed through connector plate 178, rotary/linear actuator unit 157 will be controlled to cause piston 159 to rotate in the direction of arrow B such that locking plate 161 will assume the position shown in FIG. 6. Finally, rotary/-linear actuator unit 156 is controlled to cause piston 159 to retract in the direction of arrow C in order to assure that first section 32 and second section 34 of first activity floor 34 will be securely latched together. Of course, various longitudinally spaced latching mechanisms 153 can be utilized between the sections of any given flooring and any other type of latching mechanism known in the art may also be utilized.

It should be pointed out that the particular construction of closed loop control circuit 92 is not considered part of the present invention and therefore has not been shown or described in detail. In general, closed loop control circuit 92 comprises a computer processing unit (CPU) which is programmed to sequentially operate the various control mechanisms described above in a timed fashion in response to an operator manually selecting the desired activity floor to be placed within activity area 7. For example, if first activity floor 30 is located within activity area 7 and it is desired that first activity floor 30 be replaced by second activity floor 37, an operator merely has to reposition a switch which will cause close loop control circuit 92 to uncouple the various latching mechanisms, properly position lift assembly 55 to the level of platforms 21 and 22 by adjusting the height of columns 61, reposition sections 32 and 34 of first activity floor 30 into their respective storage areas 14 and 15 by controlling motor driven cable assembly 114, again reposition lift assembly 55, shift activity floor 37 upon support base 57, actuate any locking mechanisms between first section 39 and second section 41 of second activity floor 37 and finally reposition lift assembly 55. Another activity floor can later be placed within activity area 7 in a similar fashion. All of these sequential steps will be programmed into the CPU in a manner similar to, for example, the operation of multiple, computer controlled elevators in a high-rise building. In addition, control circuit could be programmed to locate a particular activity floor at a predetermined height within activity area 7 such that the vertical wall portions of base 4 could be utilized if desired, for instance, if The multi-activity complex were to be utilized for indoor soccer or floor hockey.

Although described with respect to a preferred embodiment of the invention, it should be readily understood that various changes and/or modifications can be made to the invention without departing from the spirit thereof. For instance, it should be readily understood that the activity floors can be constructed for use in other types of sporting and exhibition events as well including tennis, volleyball, and the like. In general, the invention is only intended to be limited by the scope of the following claims.

I claim:

1. A method of alternating the playing surface in an activity area of an multi-activity complex comprising:

storing a plurality of activity floors, each of which has an associated playing surface, at vertically spaced intervals below and laterally outwardly of the activity area;

providing a lift assembly, having a support structure, below the activity area;

sectioning at least one of said plurality of activity floors and storing at least one of said plurality of activity floors in sections; and providing a locking mechanism for fixedly securing the sections of said at least one of said plurality of activity floors together when the sections are located upon the support structure of said lift assembly;

vertically moving said lift assembly such that the support structure is positioned at a height corresponding to the storage height of a selected one of said plurality of activity floors;

laterally shifting the selected one of said plurality of activity floors onto the support structure of said lift assembly; and vertically moving said lift assembly until the selected one of said plurality of activity floors is located in the activity area.

2. The method as claimed in claim 1, further comprising:

providing a fluid pressure supply system for vertically moving said lift assembly.

3. The method as claimed in claim 1, further comprising:

providing a motor driven cable assembly for alternately laterally shifting said plurality of activity floors unto the support structure of said lift assembly.

* * * * *